US009309691B2

(12) United States Patent
Chang et al.

(10) Patent No.: US 9,309,691 B2
(45) Date of Patent: Apr. 12, 2016

(54) SLIDING-DOOR HANDLE DEVICE

(71) Applicant: Door & Window Hardware Co., Taichung (TW)

(72) Inventors: Wei-Hung Chang, Taichung (TW); Sung-Hui Lin, Taichung (TW)

(73) Assignee: DOOR & WINDOW HARDWARE CO., Taichung (TW)

( * ) Notice: Subject to any disclaimer, the term of this patent is extended or adjusted under 35 U.S.C. 154(b) by 0 days.

(21) Appl. No.: 14/047,659

(22) Filed: Oct. 7, 2013

(65) Prior Publication Data

US 2015/0096149 A1 Apr. 9, 2015

(51) Int. Cl.
*E05B 1/00* (2006.01)
*E05B 65/08* (2006.01)

(52) U.S. Cl.
CPC ..... *E05B 1/0015* (2013.01); *E05B 65/08* (2013.01); *Y10T 16/458* (2015.01)

(58) Field of Classification Search
CPC ..... E05B 1/0015; E05B 1/00; E05B 1/0053; E05B 1/0069; E05B 1/04; E05B 1/06; E06B 3/4681; Y10T 16/458; Y10T 16/459; Y10T 16/469
USPC ..... 16/412, 422, 404, 413, 414
See application file for complete search history.

(56) References Cited

U.S. PATENT DOCUMENTS

| | | | | | |
|---|---|---|---|---|---|
| 610,135 | A * | 8/1898 | Green | 16/443 |
| 2,616,122 | A * | 11/1952 | Curtiss, Jr. | 16/412 |
| 3,391,674 | A * | 7/1968 | Burleigh | 119/174 |
| 3,524,215 | A * | 8/1970 | Kurtz | 16/443 |
| 3,676,895 | A * | 7/1972 | Stewart | 16/412 |
| 4,499,629 | A * | 2/1985 | Grossman | 16/413 |
| 4,805,263 | A * | 2/1989 | Kurtz | 16/443 |
| 4,922,576 | A * | 5/1990 | Weidner et al. | 16/413 |
| 5,379,821 | A * | 1/1995 | Pergolizzi et al. | 160/371 |
| 5,918,915 | A * | 7/1999 | Calteux | 292/1 |
| 6,250,044 | B1 * | 6/2001 | Funk et al. | 52/782.1 |
| 2003/0001471 | A1 * | 1/2003 | Libby et al. | 312/319.8 |
| 2004/0261226 | A1 * | 12/2004 | Moody | 16/413 |
| 2005/0005402 | A1 * | 1/2005 | Moody | 16/413 |
| 2010/0146738 | A1 * | 6/2010 | Kunnath et al. | 16/415 |
| 2012/0240472 | A1 * | 9/2012 | Bouthillier | 49/460 |
| 2013/0305490 | A1 * | 11/2013 | Sprague | 16/412 |
| 2015/0067987 | A1 * | 3/2015 | Herman | 16/412 |

* cited by examiner

*Primary Examiner* — Emily Morgan
(74) *Attorney, Agent, or Firm* — Muncy, Geissler, Olds & Lowe, P.C.

(57) ABSTRACT

A sliding-door handle device has an outside handle and an inside handle. The outside handle is mounted on and abuts the sliding door and has a connecting board and a pulling tab. The connecting board is shaped as an elongated strip and abuts an outer side of the sliding door. The pulling tab is formed on and protrudes perpendicularly from a front end of the connecting board such that the outside handle is formed in a T shape. The pulling tab has a pulling end and a pressing end. The inside handle is detachably connected to the outside handle via the sliding door to connect the outside handle with the sliding door and has an assembling mount.

4 Claims, 8 Drawing Sheets

SLIDING-DOOR HANDLE DEVICE

BACKGROUND OF THE INVENTION

1. Field of the Invention

The present invention relates to a sliding-door handle device, and more particularly relates to a sliding-door handle device that can enable a sliding door to align with a wall, so as to provide a wider passage for the user to pass through and to pull the sliding door conveniently.

2. Description of Related Art

With reference to FIG. 8, a conventional sliding door 70 (such as a glass door) with an inner side and an outer side is movably mounted on a side of a wall 80 by a rail assembly. A passage is formed between the wall and the sliding door 70 to enable the user to pass through. The conventional sliding door 70 can be moved horizontally relative to the wall 80 to open or close the passage. When the conventional sliding door 70 is moved toward the wall 80, the inner side of the conventional sliding door 70 faces to the wall 80. In order to allow users to easily push the conventional sliding door 70, two handles 60 are made U-shaped and are respectively mounted on the inner side and the outer side of the conventional sliding door 70. Each one of the handles 60 has two free ends 61 and a middle segment 62. The free ends 61 of the handle 60 are securely mounted on the conventional sliding door 70. The middle segment 62 is formed with the free ends 61 of the handle 60 and protrudes from the inner side or the outer side of the conventional sliding door 70 for the users to grip the handle 60.

The handles 60 that are securely mounted on the conventional sliding door 70 can enable the users to push the conventional sliding door 70 to move relative to the wall 80 easily. When the conventional sliding door 70 is moved toward the wall 80 by pushing the handles 60, the middle segment 62 of the handle 60 that is mounted on the inner side of the conventional sliding door 70 extends out of the inner side of the conventional sliding door 70 may hit a front edge of the wall 80. In order to prevent the handle 60 from hitting the front edge of the wall 80, a rear edge of the conventional sliding door 70 cannot align with a rear edge of the wall 80 and this will limit the width of the passage between the wall 80 and the sliding door 70.

The user can assemble only one of the handles 60 on the outer side of the sliding door 70 without assembling the other handle 60 on the inner side of the sliding door 70. Since there is no inference between the inner side of the sliding door 70 and the wall 80, the rear edge of the conventional sliding door 70 can align with the rear side of the wall 80 to provide a wider passage. When the rear edge of the conventional sliding door 70 aligns with the rear side of the wall 80 and the user standing on the side of the wall 80 opposite to the outer side of the conventional sliding door 70 wants to close the conventional sliding door 70, the user needs to move to the outer side of the conventional sliding door 70 to grip the handle 60 to move the conventional sliding door 70 relative to the wall 80 since the handle 60 is mounted only on the outer side of the conventional sliding door 70. This is inconvenient in use.

Consequently, when the conventional sliding door 70 has two handles 60 respectively mounted on the sides of the conventional sliding door 70, the rear edge of the conventional sliding door 70 cannot align with the rear edge of the wall 80. When the conventional sliding door 70 only has one handle 60 mounted on the outer side of the conventional sliding door 70, the user that stands on the side of the wall 80 cannot close the conventional sliding door 70 conveniently.

To overcome the shortcomings, the present invention provides a sliding-door handle device to mitigate the aforementioned problems.

SUMMARY OF THE INVENTION

The main objective of the present invention is to provide a sliding-door handle device that can enable the sliding door to align with a wall to provide a wider passage for the user to pass through and to pull the sliding door conveniently.

The sliding-door handle device in accordance with the present invention has an outside handle and inside handle. The outside handle is mounted on and abuts the sliding door and has a connecting board and a pulling tab. The connecting board is shaped as an elongated strip and abuts an outer side of the sliding door. The pulling tab is formed on and protrudes perpendicularly from a front end of the connecting board to form the outside handle in a T shape, and the pulling tab has a pulling end and a pressing end. The inside handle is detachably connected to the outside handle via the sliding door to connect the outside handle with the sliding door and has an assembling mount.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
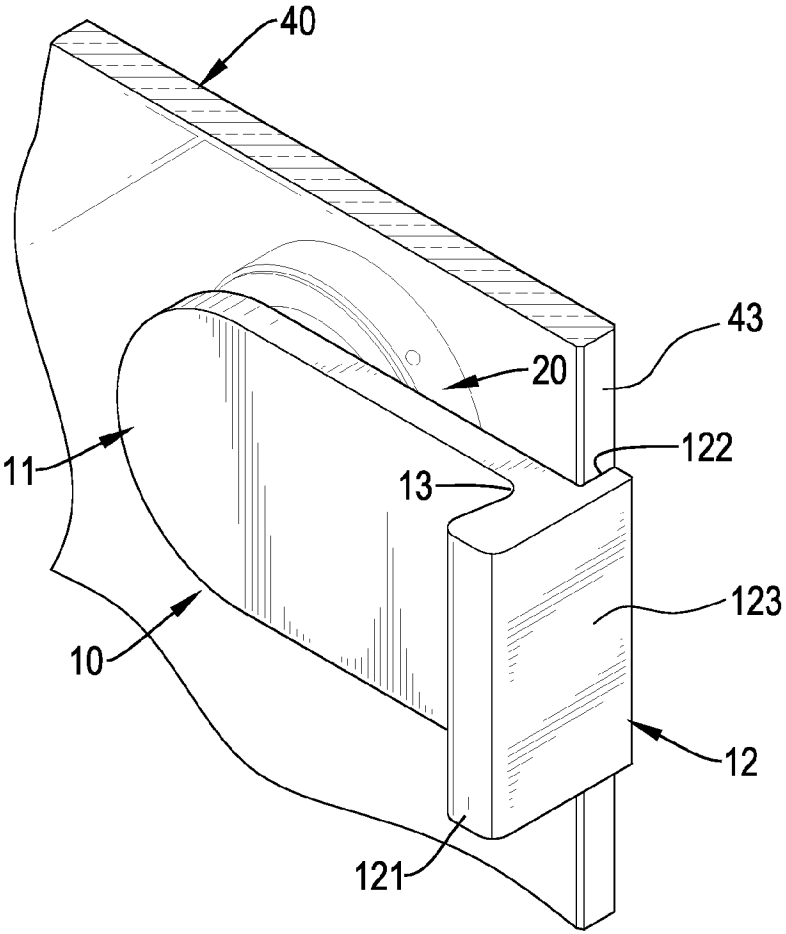
FIG. 1 is a perspective view of a first embodiment of a sliding-door handle device in accordance with the present invention, assembled on a single-open sliding door.
Figure 2:
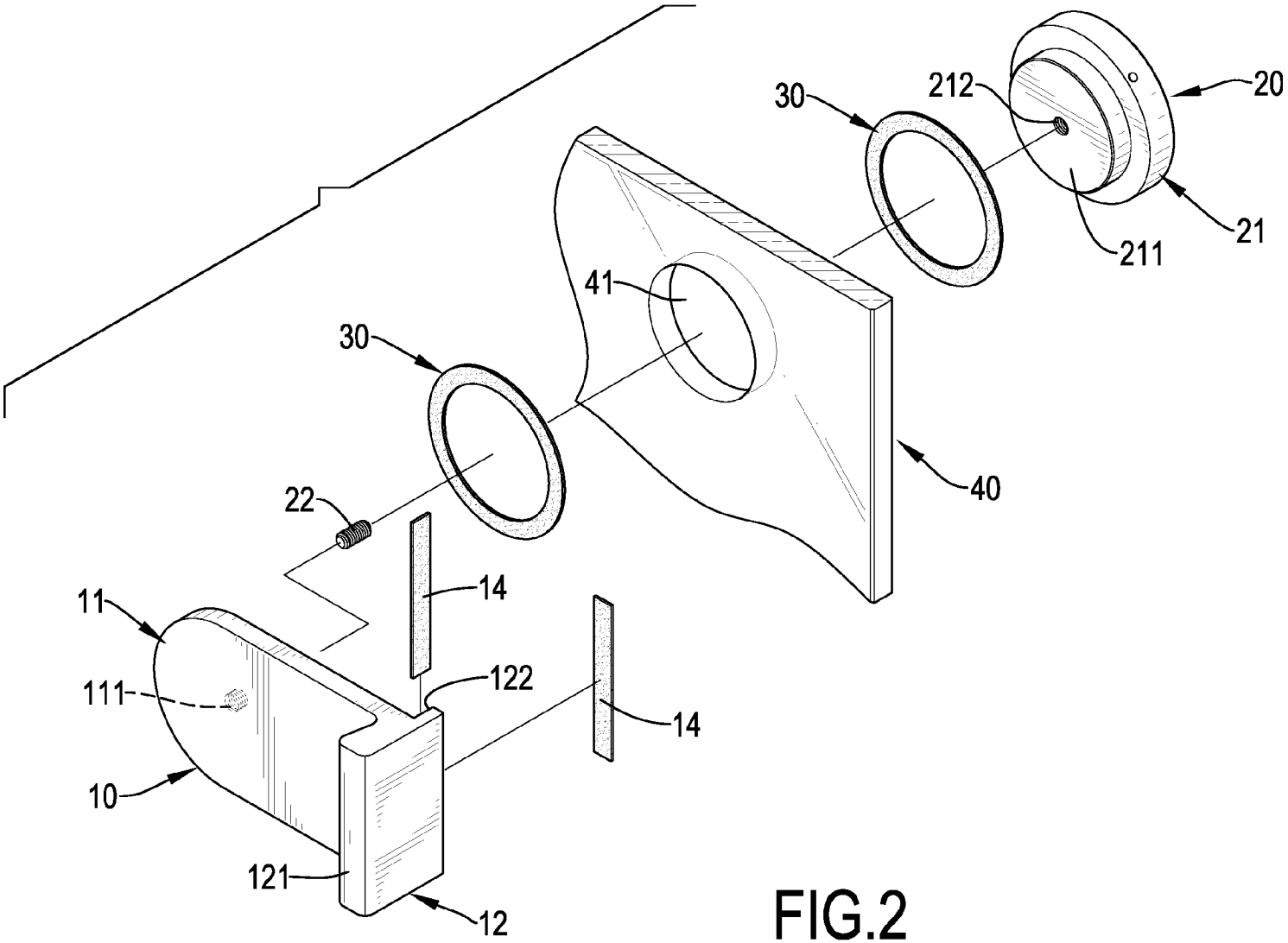
FIG. 2 is an exploded perspective view of the sliding-door handle device in FIG. 1.
Figure 3:
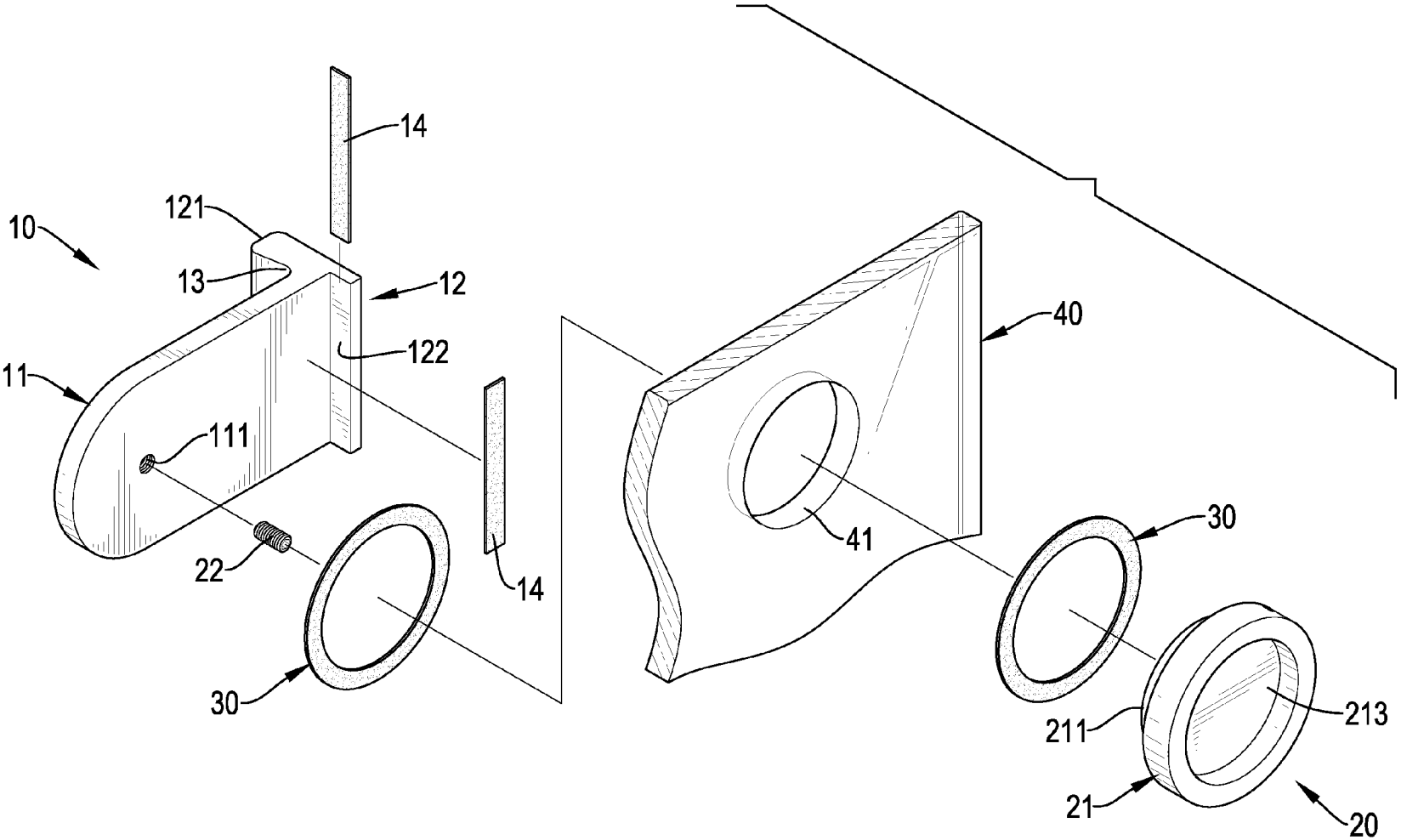
FIG. 3 is another exploded perspective view of the sliding-door handle device in FIG. 1.

With reference to FIGS. 1 to 3, a first embodiment of a sliding-door handle device in accordance with the present invention for a sliding door 40 (a single-open sliding door) having a front edge 43, a rear edge, an inner side, an outer side and a through hole 41 formed through the sliding door 40 near the front edge of the sliding door 40, and the handle device comprises an outside handle 10, an inside handle 20 and multiple washers 30.

The outside handle 10 is mounted on and abuts the outer side of the sliding door 40 and has a connecting board 11, a pulling tab 12, a hooking groove 13 and multiple mats 14.

The connecting board 11 may be shaped as an elongated strip, abuts the outer side of the sliding door 40, and has an inner side, an outer side, a rear end, a front end and a fixing hole 111. The inner side of the connecting board 11 abuts the outer side of the sliding door 40. The front end of the connecting board 11 extends to the front edge of the sliding door 40. The fixing hole 111 is formed in the inner side of the connecting board 11 near the rear end of the connecting board 11 and aligns with the through hole 41 of the sliding door 40.

The pulling tab 12 is formed on and protrudes perpendicularly from the front end of the connecting board 11 such that the outside handle 10 is formed in a T shape. The pulling tab 12 has a pulling end 121 and a pressing end 122. The pulling end 121 of the pulling tab 12 is formed on, protrudes from and extends out of the outer side of the connecting board 11. The pressing end 122 of the pulling tab 12 is formed with the pulling end 121 of the pulling tab 12, is formed on and protrudes from the inner side of the connecting board 11 and abuts the front edge of the sliding door 40. Front ends of the pulling end and the pressing end define an upright front side surface 123. When a user hooks the pulling end 121 of the pulling tab 12 to move the sliding door 40, the pressing end 122 abuts against the front edge of the sliding door 40 to provide an abutment-support effect to the pulling tab 12.

Figure 4:
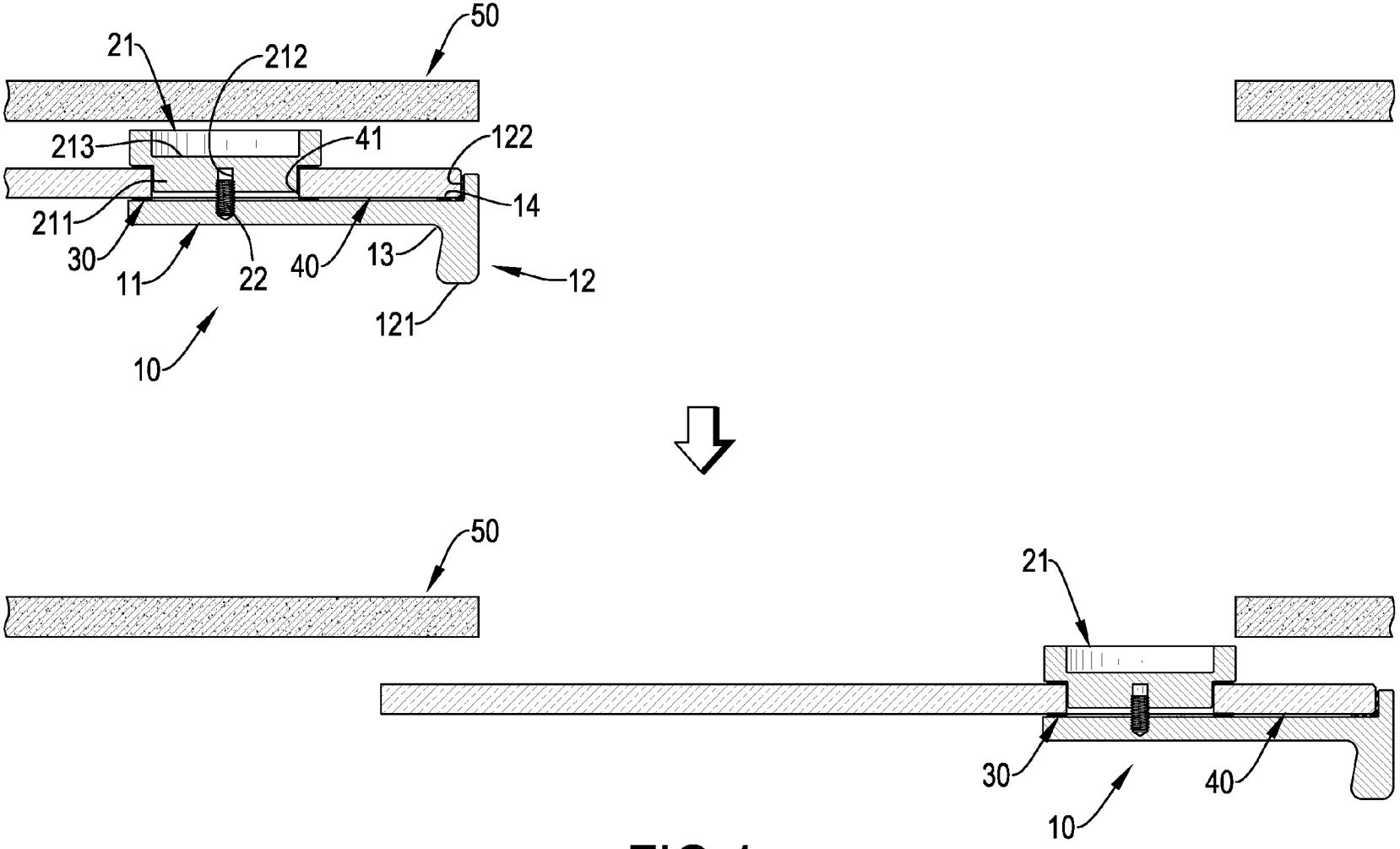
FIG. 4 is operational top views of the sliding-door handle device in FIG. 1 showing the handle device respectively in a closed state and an open state.

With reference to FIG. 4, the hooking groove 13 is circular and is formed between the outer side of the connecting board 11 and the pulling end 121 of the pulling tab 12 for a user to hook the pulling end 121.

The mats 14 are mounted between the connecting board 11, the pressing end 122 of the pulling tab 12, and the sliding door 40.

With further reference to FIGS. 2 and 4, the inside handle 20 is detachably connected to the outside handle 10 via the through hole 41 of the sliding door 40 to connect the outside handle 10 with the sliding door 40, is securely mounted on and abuts the inner side of the sliding door 40 and has an assembling mount 21 and a bolt 22.

The assembling mount 21 has an inner side, an outer side, a mounting block 211 and a recess 213. The inner side of the assembling mount 21 abuts the inner side of the sliding door 40. The outer side of the assembling mount 21 extends out of the through hole 41 of the sliding door 40.

The mounting block 211 is formed on and protrudes from the inner side of the assembling mount 21, is mounted in and corresponding to the through hole 41 of the sliding door 40 to face the connecting board 11, and has a center and a threaded hole 212. The threaded hole 212 is formed in the center of the mounting block 211 and aligns with the fixing hole 111 of the connecting board 11 via the through hole 41 of the sliding door 40. The recess 213 is formed in the outer side of the assembling mount 21. The bolt 22 is mounted in the threaded hole 212 of the mounting block 211 and the fixing hole 111 of the connecting board 11 via the through hole 41 of the sliding door 40 to connect the outside handle 10 and the inside handle 20 with the sliding door 40.

The washers 30 are mounted between the outside handle 10, the inside handle 20, and the through hole 41 of the sliding door 40.

Figure 6:
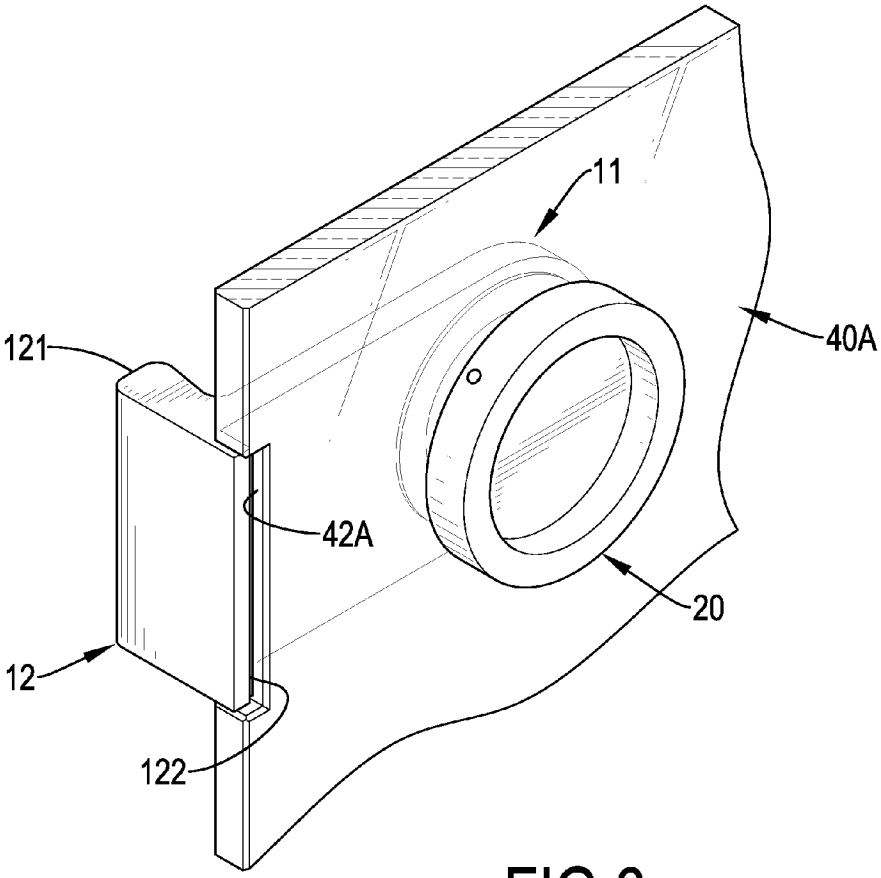
FIG. 6 is a perspective view of a second embodiment of a sliding-door handle device in accordance with the present invention, assembled on a double-open sliding door.
Figure 7:
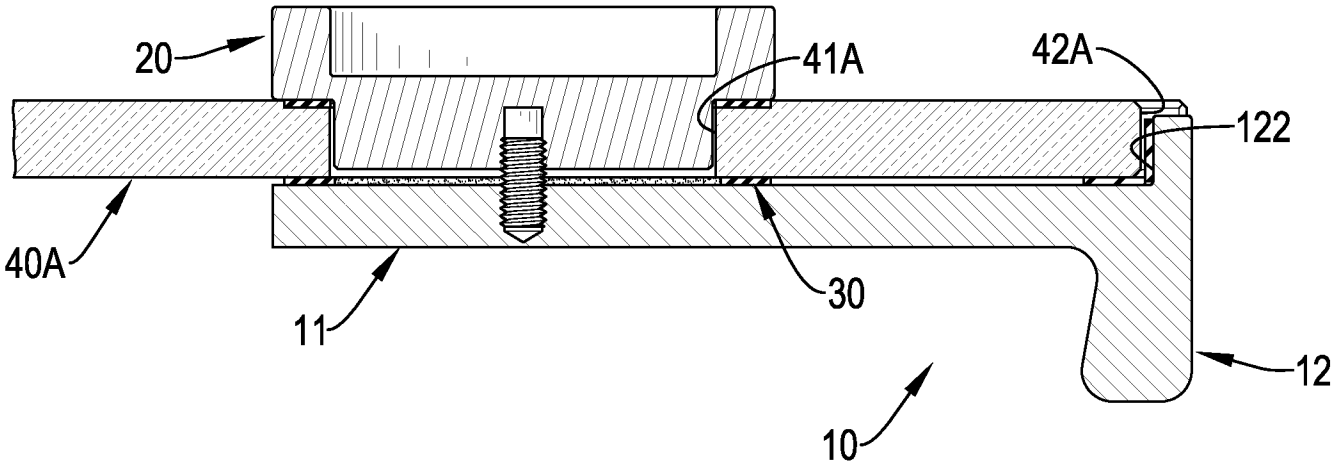
FIG. 7 is a cross sectional top view in partial section of the handle device in FIG. 6.
Figure 8:
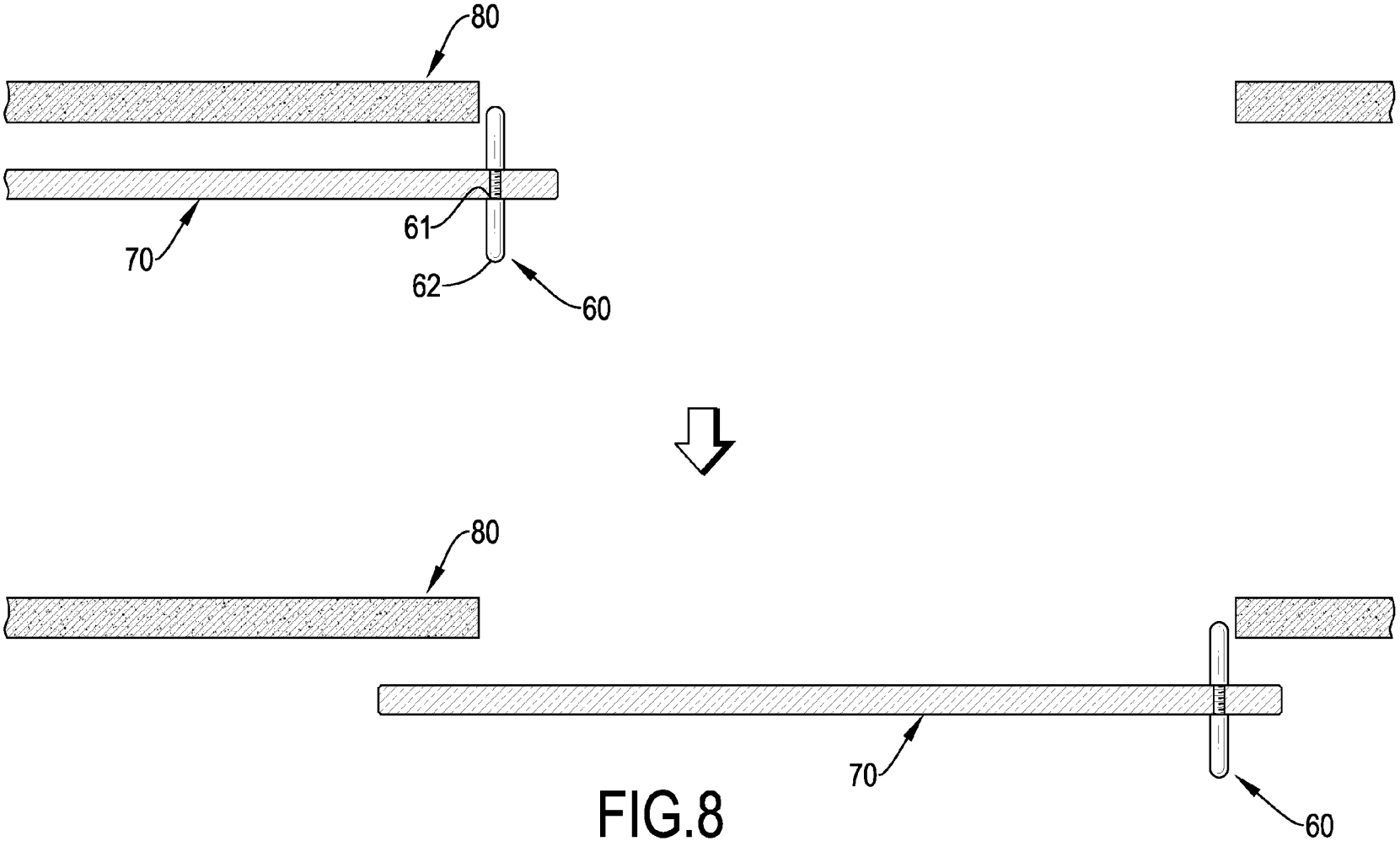
FIG.8 PRIOR ART
FIG. 8 is operational top views of a sliding-door handle device in accordance with the prior art showing the handle device respectively in a closed state and an open state.

With reference to FIGS. 6 and 7, a second embodiment of a handle device in accordance with the present invention for a sliding door 40A (a double-open sliding door) having a front edge, a rear edge, an inner side, an outer side, a through hole 41A formed through the sliding door 40A near the front edge of the sliding door 40A, and a mounting recess 42A formed in the front edge of the sliding door 40A with a bottom face. The second embodiment of the handle device has similar structures substantially same as the structures in the above-mentioned first embodiment of the handle device except that the pressing end 122 of the pulling tab 12 is mounted in the mounting recess 42A of the sliding door 40A and abuts the bottom face of the mounting recess 42A to provide an abutment-support effect to the pulling tab 12.

According to the above-mentioned first embodiment of the handle device, with reference to FIG. 4, in assembly, the outside handle 10 is separated from the inside handle 20, the inner side of the connecting board 11 is mounted on and abuts the inner side of the sliding door 40, and the pressing end 122 of the pulling tab 12 is mounted on and abuts the front edge of the sliding door 40. The mats 14 are mounted between the sliding door 40, the connecting board 11, and the pressing end 122 of the pulling tab 12. The bolt 22 is connected to the fixing hole 111 of the connecting board 11 via the through hole 41 of the sliding door 40, the mounting block 211 is mounted in the through hole 41 of the sliding door 40, and then the bolt 22 is connected to the threaded hole 212 to enable the inside handle 20 to connect with the outside handle 10 on the sliding door 40. Alternatively, the bolt 22 also can be first connected to the threaded hole 212 of the mounting block 211, and then the mounting block 211 is mounted in the through hole 41 of the sliding door 40 such that, by rotating the mounting block 211, the blot 22 is connected to the fixing hole 111 of the connecting board 11 to connect the outside handle 10 with the inside handle 20 on the sliding door 40. The assembling sequence of the handle device in accordance with the present invention is not limited.

Figure 5:
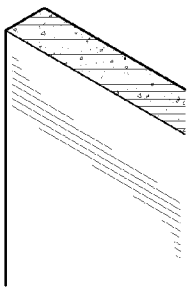
FIG. 5 is an operational perspective view of the sliding-door handle device in FIG. 1 in an open state.
Figure 5:
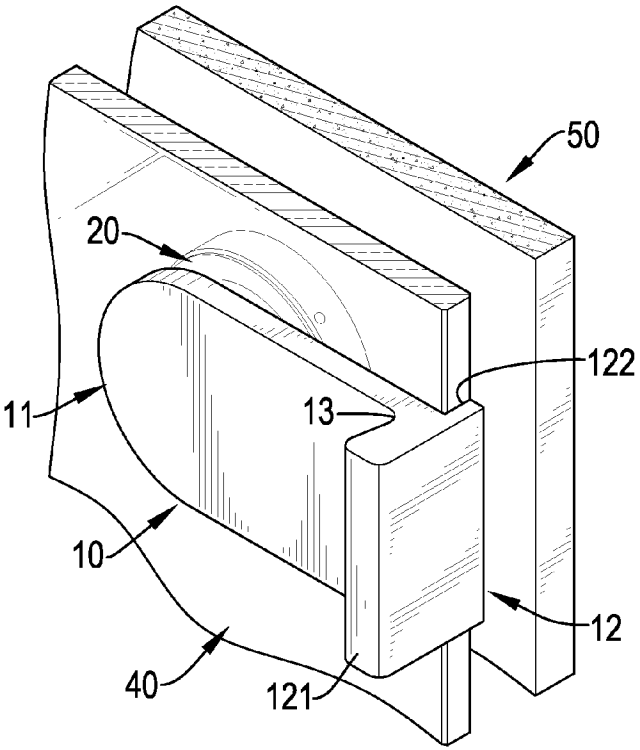

In use, with reference to FIGS. 4 and 5, when the sliding door 40 is moved relative to a wall 50 to close a passage formed between the wall 50 and the sliding door 40, if a user stands at the outer side of the sliding door 40, the user can push the outside handle 10 to move the sliding door 40 toward the wall 50 to open the passage. When the siding door 40 is moved toward the wall 50, since the assembling mount 21 is mounted on the inner side of the sliding door 40 without extending out of the sliding door 40, and this can enable the assembling mount 21 to be located in a gap between the sliding door 40 and the wall 50 without hitting the wall 50. Then, the rear edge of the sliding door 40 can align with a rear edge of the wall 50 to enable the passage to be fully opened without interfering with the sliding door 40, and this can provide a wider passage for the user to pass through. In addition, when the passage is closed and the user stands at the side of the wall 50, the user can insert fingers into the recess 213 to push the assembling mount 21 as shown in FIG. 3, so as to enable the sliding door 40 to move toward the wall 50 to open the passage easily and conveniently.

Furthermore, with reference to FIG. 4, when the rear edge of the sliding door 40 aligns with the rear edge of the wall 50 to open the passage and the user stands at the side of the sliding door 40, the user can close the passage of the wall 50 by putting hands into the hooking groove 13 to push the sliding door 40 with the outside handle 10 to close the passage of the wall 50. When the user stands at the side of the wall 50, the user's hands can reversely hook the pulling tab 12 without moving at the side of the sliding door 40 to move the sliding door 40 to move relative to the wall 50 to close the passage of the wall 50 and this is convenient in use.

Even though numerous characteristics and advantages of the present invention have been set forth in the foregoing description, together with details of the structure and features of the invention, the disclosure is illustrative only Changes may be made in the details, especially in matters of shape, size, and arrangement of parts within the principles of the invention to the full extent indicated by the broad general meaning of the terms in which the appended claims are expressed.

What is claimed is:

1. A sliding-door assembly comprising:

a sliding door having a front edge, a rear edge that is opposite to the front edge, an inner surface that is connected between the front and rear edges, and an outer surface that is opposite to the inner surface and that is connected between the front and rear edges, the sliding door movable in a direction of either the front or rear edges;

an outside handle having:

a connecting board shaped as an elongated strip that extends in a first horizontal plane, and having an inner side that faces the outer surface of the sliding door, an outer side, a rear end and a front end; and a pulling tab formed on and protruding perpendicularly from the front end of the connecting board, and having a pulling end formed on, protruding from and extending out of the outer side of the connecting board, and a pressing end, abutting the front edge of the sliding door, and formed with the pulling end of the pulling tab, formed on and protruding from the inner side of the connecting board, said pulling end and said pressing end being substantially aligned with each other in a second horizontal plane that is perpendicular to the first horizontal plane, front ends of said pulling end and said pressing end cooperatively defining an upright front side surface; and an inside handle detachably connected to the outside handle and having;

an assembling mount having an inner side facing to the inner side of the connecting board and abutting against the inner surface of the sliding door, an outer side, and a recess formed in the outer side of the assembling mount, and a mounting block formed on and protruding from the inner side of the assembling mount , extending through the sliding door, and connected to the connecting board to connect the outside handle with the inside handle;

wherein the outside handle is formed in a T shape by the connecting board and the pulling tab; and wherein the pressing end of the pulling tab is adapted to abut against the front edge of the sliding door, thereby facilitating access of the pulling end to a user standing at a side of the sliding door opposite to the outside surface.

2. The sliding-door assembly as claimed in claim 1, wherein the connecting board has a fixing hole formed in the inner side of the connecting board near the rear end of the connecting board;

the mounting block has a center and a threaded hole formed in the center of the mounting block and aligning with the fixing hole of the connecting board; and the inside handle has a bolt mounted in the threaded hole of the mounting block and the fixing hole of the connecting board to connect the outside handle with the inside handle.

3. The sliding-door assembly as claimed in claim 2, wherein the mounting block is connected to the connecting board near the rear end of the connecting board and opposite to the pulling tab.

4. The sliding-door assembly as claimed in claim 1, wherein the mounting block is connected to the connecting board near the rear end of the connecting board and opposite to the pulling tab.

* * * * *